United States Patent [19]

Eckels

[11] Patent Number: 4,773,132

[45] Date of Patent: Sep. 27, 1988

[54] TACTILE SIGNALLING ABSORPTION INDICATOR

[76] Inventor: Robert E. Eckels, 49 S. Lookout Mountain Rd., Golden, Colo. 80401

[21] Appl. No.: 100,835

[22] Filed: Sep. 25, 1987

[51] Int. Cl.[4] ..... A44B 21/00

[52] U.S. Cl. ..... 24/545; 24/557; 24/562

[58] Field of Search ..... 24/545, 543, 557, 489, 24/536, 561, 562, 564; 15/244 R, 244 A, 245

[56] References Cited

U.S. PATENT DOCUMENTS

| | | | |
|---|---|---|---|
| 1,761,630 | 6/1930 | Jentzen | 24/562 |
| 2,310,156 | 2/1943 | Van der Clute | 24/562 |
| 3,060,536 | 10/1962 | La Voie | 24/545 |
| 3,137,880 | 6/1964 | Kubit et al. | 15/244 R |
| 3,453,700 | 7/1969 | Petertil et al. | 24/557 |
| 3,756,096 | 9/1973 | Bolden | 24/564 |
| 3,797,076 | 3/1974 | Watkin | 24/562 |
| 3,962,758 | 6/1976 | Knappe et al. | 24/562 |
| 4,312,089 | 1/1982 | Taylor | 24/545 |
| 4,434,535 | 3/1984 | Woodley | 24/562 |
| 4,669,152 | 6/1987 | Alexander | 24/562 |

FOREIGN PATENT DOCUMENTS

| | | | |
|---|---|---|---|
| 591321 | 7/1925 | France | 24/536 |
| 8199 | of 1890 | United Kingdom | 24/561 |

*Primary Examiner*—Victor N. Sakran

*Attorney, Agent, or Firm*—James E. Pittenger

[57] ABSTRACT

A hand held holder includes a handle portion which joins two outwardly extending bifurcated legs which form an acute angle from said handle. Sharp-edged ridges on lateral teeth are provided on the inside surface of each of the legs and are arranged to extend at least partially across the width of the legs to provide a contact surface for a food item or object which is to be immersed. The outer ends of the legs terminate in a curved section or backwardly angled surface to guide the object into the teeth of the device. The resiliency of the material which forms the handle and legs of the device is sufficient to create a relatively strong compressive force on the surface of the object when it is gripped by the teeth so that, during the immersion in the liquid, when the object has reached suitable saturation, the compressive energy will be suddenly released, causing actual movement of the legs which creates a tactile or visual signal for the user. This signal provides an indication that the object is suitably saturated and ready for removal.

20 Claims, 2 Drawing Sheets

TACTILE SIGNALLING ABSORPTION INDICATOR

FIELD OF THE INVENTION

The present invention is directed to a holder for supporting objects while being submerged in a liquid. It is more specifically directed to a device which is intended to support an object submerged in a liquid and indicate when that object has absorbed a proper amount of the liquid.

BACKGROUND OF THE INVENTION

In the past, in order to be able to soften or soak a food product such as a cookie to a palatable consistency it has been common to immerse the item in an edible liquid in order that the food will absorb the liquid and soften to a desirable texture. This act is usually called "dunking" and is a very common practice when eating certain food products such as donuts, cookies or crackers. Many people regularly use cold milk or chocolate milk when dunking or softening these items.

When eating cookies, especially small cookies such as vanilla wafers, it is difficult to dunk or immerse the cookie in the liquid without getting the fingers wet or turning the cookie into a mushy or soggy mass. The present invention is intended to eliminate these problems by providing a convenient holder for the cookie while it is submerged in the liquid and to provide a warning signal or indication when the proper consistency has been reached.

There are a number of other products or objects which also can be utilized in a device of this type. At times objects such as sponges or industrial products or processes require that an object be held in a submerged state in a liquid and at the proper time or consistency the holder and object is removed from the liquid. In this way, the object has absorbed a proper amount of liquid in conformance with the required industrial process. Up to this point the prior art has not indicated any holder of this type which would suffice and provide a signal or indication of the absorbency. Thus, a real need exists for a product of this type which can perform this function.

SUMMARY OF THE INVENTION

The present invention provides a holder or clasp having bifurcated legs which are suitably angled with respect to each other to receive and hold one or more cookies or other objects as desired. The outwardly extending legs are arranged at an acute angle to provide this space. On the inside surface of each of the legs is formed a set of lateral sharp-edged ridges or teeth which are designed to properly grip and contact the object to obtain the desired retention.

The spacing and size of the teeth are designed in conjunction with the elasticity and resilience of the material of the device to provide the proper compressive force on a very small, concentrated area on the object's surface.

As illustrated herein, a cookie dunking device or holder is shown. The sharp edges of one or more teeth on each leg can be held in contact with the surface of a cookie by the compressive force generated between the legs of the device to provide the proper retention. The angle of the teeth extending inwardly from the open area can be of a flatter angle than the angle of the teeth on the opposite side. This flattening configuration can aid in permitting the easy insertion or slidablility of the cookie into the device until it reaches the proper position. By the same token, the angular direction of the teeth can be angled toward or away from the handle of the device to make it easier to insert or remove the food depending upon the intended use and preference.

The insertion of one or more cookies causes the legs to spread and apply the desired compressive forces upon the outer surface of the object. By immersirg the cookie in the desired liquid while holding the handle portion of the device, a decided, sudden movement of the legs or "pop" can be felt in the fingers gripping the device when the liquid has soaked to the proper depth. This is caused by the legs springing back to substantially their original position when the surface of the cookie under the compressive forces of the teeth can no longer be supported.

This tactile signal indicates to the user that the object should be removed immediately to prevent further absorption of the liquid which would cause the cookie or object to become overly soft or soggy. Naturally, the temperature of the liquid in which the object is being immersed will greatly determine the actual time that is necessary from the moment that the object is first immersed and the signal is provided. In some cases the object may be so soft or may gradually absorb the liquid which will cause the legs of the device to progressively or slowly move together rather than having a sudden release of the compressive energy. In this case the signal is noted by the movement of the legs where the actual movement of the legs can be measured by an electronic instrument or other suitable device attached to the handle of the holder.

While throughout this application reference for illustrative purposes is primarily made to cookies, it is to be understood that as stated above the invention can be used with any other type of product or object which has a firm or hard surface and is soaked in a liquid in order to soften it and make it more usable or palatable. Because of the angular arrangement of the legs of the device, a wide range of objects can be accommodated.

BRIEF DESCRIPTION OF THE DRAWINGS

Other features and advantages of the present invention become apparent from the following detailed description of the invention wherein like reference numbers denote the same elements in the accompanying drawings.

DETAILED DESCRIPTION OF THE INVENTION

Figure 1:
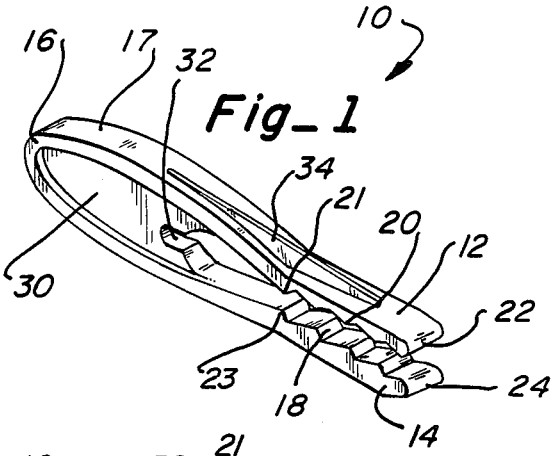
FIG. 1 is a perspective view of the tactile signalling indicator as provided in the present invention.
Figure 3:
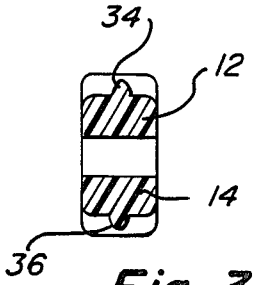
FIG. 3 is a sectional view taken along the lines 3—3 ; of FIG. 2.
Figure 2:
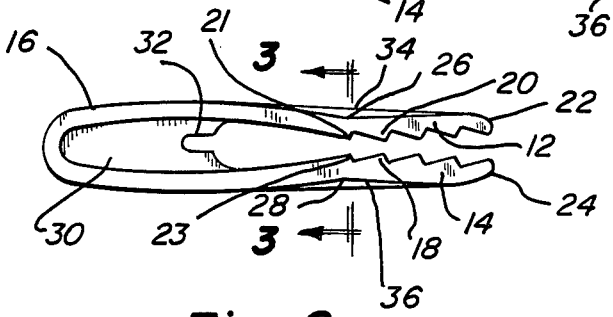
FIG. 2 is a side view.

Turning now more specifically to the drawings, FIGS. 1, 2 and 3 show a preferred embodiment of the tactile signalling indicator device 10 as provided in the present invention. The indicator device 10 has outwardly extending bifurcated legs 12, 14 joined together at their apex 16 which forms a handle 17. Teeth 18, 20 formed on the inside facing surfaces of the legs 12, 14 can be arranged to coincide and form a complimenting image of the opposite counterpart. In use, one or more objects such as cookies are inserted between the teeth 18, 20 so as to spread the legs 12, 14 apart at least a short distance. By holding the handle portion 17 between the user's fingers, it is particularly easy to submerge an object such as a cookie into a container containing liquid without getting the fingers wet or soiled. The free ends of the legs 12, 14 terminate in a substantially rounded configuration 22, 24 which is provided to allow the object to be inserted easily between the legs and into the teeth.

Throughout the remainder of this description the object which is used with the device will be described for the sake of illustration as a cookie. Thus, any relatively flat cookie or other object having a relatively firm outer surface can be utilized with the present device. As will be explained later a number of other materials and objects can also be used with the device for various purposes wherein it is desired to soak the object in a fluid to a point where a desired consistency or condition is obtained.

As shown in FIG. 2, the teeth 18, 20 are mounted on the inside surface of legs 12, 14. These teeth are arranged to be symmetrical and concurrent in that the apex or peak of the teeth are aligned directly opposite each other. The forward side of the teeth, that is the side closest to the outer free end of the legs has a steeper angle than the rear surface of the teeth which has a flat or shallow angle. This permits the cookie while it is still fairly rigid to be inserted between the teeth and yet be removed relatively easy after it has been softened because of the shallow angle of the rear surface of the teeth. Thus, this tooth configuration allows the cookie to be inserted easily but removed with even less effort.

It is to be understood that the apex of each tooth forms a sharp and distinct line extending transversely across the width of the leg. In this way the contact line where the tooth meets the surface of the cookie forms a very small contact area which concentrates the compressive force generated by the legs as they are expanded during the insertion of the cookie. It is to be understood that the configuration of the teeth can be varied with respect to the angle of the forward and rearward surface as desired. Thus, depending upon the objects with which the device is intended to be used the forward angle could be greatly decreased with respect to the longitudinal axis with the rearward angle greatly increased so that it would be much easier to insert the object with a greater resistance to the actual removal of the object once the absorption has taken place.

In order to provide the necessary compressive forces and also to increase the functional capability of the device it has been found desirable to taper inwardly the outer surface of the legs to a point which is adjacent to the innermost teeth 21, 23. This forms a crease or indentation 26, 28 in the outer surface of the legs. From this point the legs taper slightly outward as they move toward the handle portion 17. For additional ridity and strength a gusset 34 can be provided along the outer surface of each leg 12, 14. The handle portion 17 is formed as the legs are joined in a U-shaped configuration. Thus, the legs themselves can be relatively wide but thin such as having a width of $\frac{1}{4}''$ with the actual thickness of approximately $\frac{1}{8}''$. A web portion 30 is formed in the handle area 17 to interconnect the inner surfaces of the legs and improve the handle characteristics of the device as well as provide an interconnection between the legs and improve the strength of the legs as they are separated. The actual web can extend as much as two-thirds along the space between the legs from the apex 16 toward the teeth area. A slot 32 can be provided along the longtitudinal axis of the device and ending in a radius to reduce stress concentration in the material. This slot provides additional flexibility in the bifurcated legs to permit the separation of the legs to allow the the insertion of the cookie. If desired, and depending upon the characteristics of the material used, the dimensions of the legs, handle, web and slot can be varied to povide the desired rigidity, flexibility and compressive force to obtain the desired results.

Figure 4:
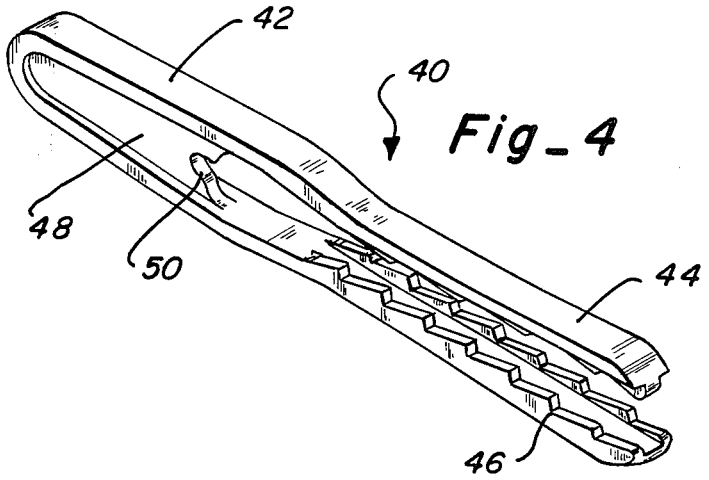
FIG. 4 is a perspective view of another embodiment of the tactile signalling indicator showing the upper leg having a narrow center section while the lower leg has two upwardly extending spaced sections.
Figure 5:
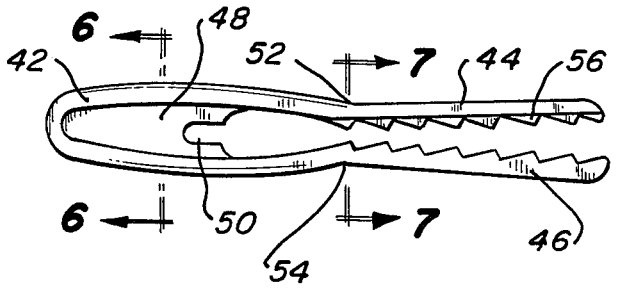
FIG. 5 is a side view of the embodiment shown in FIG. 4.
Figure 6:
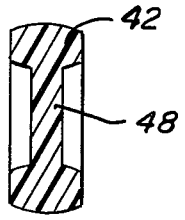
FIG. 6 is a sectional view taken along 6—6 of FIG. 5.

FIG. 4 shows another embodiment of the tactile signalling device according to the present invention wherein the holder or device 40 includes handle area 42 and bifurcated legs 44, 46. Handle 42 includes the web 48 and flexibility adjustment slot 50.

For flexibility, the legs can have the same outer configuration as previously described wherein the backward taper of the outward surface of the legs 44, 46 meets the forward taper of the handle surfaces in detent or low areas 52, 54. As previously described, if it is necessary to provide additional strength or rigidity to the legs, it is possible to provide a gusset along the outer surfaces through the areas 52, 54. In the present embodiment, the legs are extended so that they are substantially longer than the arrangement shown in FIGS. 1–3. In this way, greater leverage and compressive forces can be applied to the cookie or object depending upon where it is positioned within the teeth and with respect to the distance from the handle. The softer objects can be positioned closer to the outer free ends of the legs 44, 46 with more solid or rigid objects positioned further back in the teeth.

Figure 7:
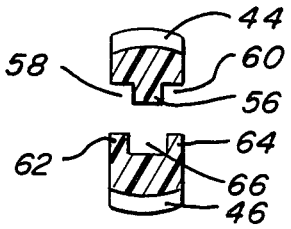
FIG. 7 is a sectional view taken along lines 7—7 of FIG. 5.

As shown in FIGS. 4 and 7, the upper leg 44 has the outer edges of teeth 56 cut away on the edges 58, 60 so that the teeth are approximately half of the width of the leg 44. Directly opposite on the inside surface of leg 46 are positioned a double row of teeth 62, 64. A slot 66 which is slightly larger than the width of teeth 56 is provided between the double row of teeth 62, 64 provided on the bottom leg 46. In this way, the teeth on the top leg and bottom leg interfit so as to provide additional movement between the legs 44, 46.

During use the cookie or object is inserted between the legs 44, 46 so that the teeth 46, 62, 64 contact the surface of the object. These teeth have an apex which is a line or sharp ridge which applies a more concentrated force on the surface of the cookie. However, in this embodiment a shear force is transmitted within the cookie or object which subjects the cookie to additional force during submergence and absorption of the liquid. Thus, a slightly different tactile signal and feel is provided in this embodiment which can be arranged to compensate for the type of cookie or object that is being held. In addition, different forces can be applied to the object by carefully positioning the object in the teeth which are closer to the outer free end of the legs or toward the back teeth where additional compressive forces are applied.

Figure 9:
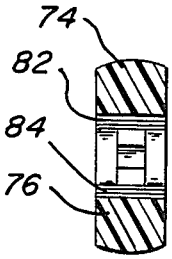
FIG. 9 is a cross sectional view taken along lines 9—9 of FIG. 8.
Figure 8:
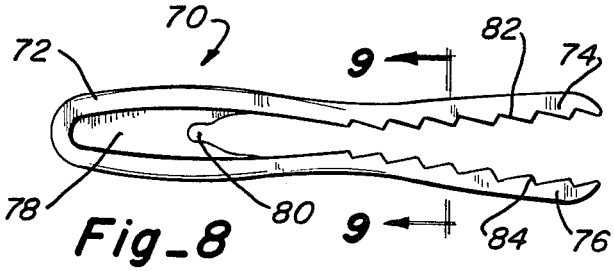
FIG. 8 is a side view of another embodiment of the tactile si indicator.

FIGS. 8 and 9 show another variation of the tactile signal device or holder 70 having handle 72, legs 74, 76. Handle 72 includes web 78 and slot 80. This regiment is similar to the previous embodiment with the exception that the teeth 82, 84 on the legs 74, 76, respectively extend the full width of the legs 74, 76 to provide the additional contact surface with the cookie or object. Thus, with the additional length of the legs 74, 76 the actual contact force placed upon the cookie can be considerably varied depending upon where the object is placed between the teeth near the outer free end of the legs 74, 76 or between the inner teeth closer to the handle 72. Although this arrangement may not be as desirable when utilizing the device with cookies, this variation may become very important when using the holder with other objects such as sponge pads or cardboard disks. With this embodiment a considerable latitude in the objects with which the device is used is possible. In this way, the usefulness of the device can be greatly extended.

The material which is selected for manufacturing or molding the tactile signalling device can be selected from any group which provides the desired flexibility and rigidity. In addition, it is desirable that the material with which the device or holder is made does not itself absorb any of the liquid in which it is intended to be used. Other considerations for selection may be the ease with which the device can be machined or molded and still keep the costs within reason so that the device can be economically feasible. The material selected can be plastic, such as polyvinylchloride or polycarbonate, or synthetic resins or metals such as aluminum, copper or stainless steel. Thus, the material itself is selected depending upon the characteristics which are required to provide the desired holding and compressive forces when the device is in use.

While the above invention has been shown and described in detail in this application, it should be understood that this invention is not to be limited to the exact form disclosed and changes in detail and construction of the invention may be made without departing from the spirit thereof.

What is claimed is:

1. A holding device for gripping an object which is softened by being submerged in a liquid, the device comprising:

(a) a handle means for providing a suitable gripping surface so that the device can be supported by the fingers of the user;

(b) a pair of generally wide, bifurcated legs which are attached to and extend outwardly from the handle means so as to form an acute angle, the angle between the legs is arranged to provide a clearance between the free ends of the legs which is slightly greater than the anticipated thickness of the intended object to be submerged;

(c) gripping teeth formed on the inside surface near the free end of each leg, the teeth being identical and having an equilateral cross section, the apex of the teeth on one leg being arranged to coincide with the apex of the teeth on the opposite leg, said teeth being formed so that the object contact area along each apex is a narrow contct line extending the width of the leg; and (d) said bifurcated legs and handle means being formed from a resilient material which will create a realtively high compressive force between the legs which is transmitted through the tooth contact areas to the surface of the object when it is inserted between the legs, the sizing of the teeth on said legs being provided so that a maximum of one to three teeth on each of the legs will be in contact with the surface of the object to be submerged, the narrow contact line of each tooth and the angle between the bifurcated legs being arranged to create a relatively high compressive loading on the surface of the object so that when the item is submerged in the liquid the compressive forces will be suddenly released due to the softening of the material to provide a signal to the user that the submerged item has reached the proper saturation.

2. A holding device as defined in claim 1 wherein the teeth formed on said legs are identical, the teeth on one leg being arranged opposite to and coinciding with the teeth on the opposite leg.

3. A holding device as defined in claim 1 wherein the angle between the difurcated legs and the positioning of the teeth on said legs are arranged so that a maximum of one to three teeth on each of the legs will be in contact with the surface of the object.

4. A holding device as defined in claim 1 wherein a means is positioned in contact with both legs whereby relative movement between the legs of the holding device will be registered and signalled.

5. A holding device as defined in claim 4 wherein the means for measuring the movement is an electronic sensor means providing an output when movement is registered and a signalling means which is energized by the output of the sensor means whereby the relative movement will indicate that the object has reached the proper saturation.

6. A holding device for gripping an object which is softened by being submerged in a liquid, the device comprising:

(a) a handle means for providing a suitable gripping surface so that the device can be supported by the user;

(b) a pair of relatively wide, bifurcated legs which extend outwardly from the handle means forming an acute angle, the angle between the legs is arranged to provide spacing for the reception of an object to be submerged;

(c) gripping teeth formed laterally on the inside surface of each leg, said teeth forming an elongated, sharp ridge at each apex extending across at least a portion of the width of the leg; and (d) said bifurcated legs being formed from a resilient material which will create a relatively high compressive loading force through the tooth contact area on the object when it is inserted therebetween whereby as the object is immersed in the liquid the compressive loading created by the legs will be released due to the softening of the surface of the object to provide an indication to the user that the immersed object has reached proper saturation.

7. A holding device as defined in claim 6 wherein the teeth in cross section are equilateral triangles.

8. A holding device as defined in claim 6 wherein the cross section configuration of each tooth is arranged with one side greater than the other whereby the teeth are slanted toward the handle to facilitate the insertion of the object.

9. A holding device as defined in claim 6 wherein the cross section configuration of each tooth is arranged with one side greater than the other whereby the teeth are slanted toward the end of the legs to facilitate the removal of the object.

10. A holding device as defined in claim 6 wherein each of the bifurcated legs terminates at their free ends in a rounded surface to facilitate the insertion of the object between the legs.

11. A holding device as defined in claim 6 wherein each of the bifurcated legs terminates at their free ends in a flat inwardly angled surface which is angled toward the opening between the legs to provide lead-in surfaces for the insertion of the object.

12. A holding device as defined in claim 6 wherein the apex of each tooth forms a narrow contact line on the surface of the object when properly inserted so that relatively high compressive loading forces are applied to the surface.

13. A holding device as defined in claim 6 wherein the teeth on one leg are centered along the inside surface of the leg and extend approximately one half of the width of the leg, and the teeth on the opposite leg have a centrally positioned slot which coincides with an is slightly wider than the teeth on the opposite leg whereby the teeth on the two legs can interfit to apply a shear force on the object being held.

14. A holding device as defined in claim 2 wherein the device is formed as a one piece integral unit from resilient flexible plastic material.

15. A holding device as defined in claim 2 wherein an elongate gusset is formed on the outer surface of each leg so as to support and stengthen the legs and to provide the desired compressive force on the object.

16. A holding device as defined in claim 2 wherein the relative movement of the legs is sudden which produces a tactile indication signal to the user.

17. A holding device as defined in claim 6 wherein the teeth on the bifurcated legs extend the entire width of the respective leg.

18. A holding device for gripping cookies or other firm food items which is softened by being submerged in a liquid, the device comprising:

(a) a handle means for providing a suitable gripping surface so that the device can be supported by the fingers of the user;

(b) a pair of bifurcated legs which are attached to and extend outwardly from the handle maans so as to form an acute angle, the angle between the legs is arranged to provide a clearance between the free ends of the legs which is slightly less than the anticipated thickness of the intended food item to be submerged;

(c) one or more gripping teeth formed laterally on the inside surface near the free end of each leg, each of the teeth being formed identically and the apex of the teeth on one leg being arranged opposite to and coinciding with the apex of the teeth on the opposite leg, said teeth being formed so as to have a sharp edge apex so that the food contact area along each apex is a narrow contact area extending the full width of the leg; and (d) said bifurcated legs and handle means being formed from a strong, resilient material which will create a relatively high compressive force between the legs which is transmitted through the tooth contact areas to the surface of the food item when it is inserted between the legs, the sizing and the spacing of the teeth on said legs being provided so that a maximum of one to three teeth on each of the legs will be in contact with the surface of the food item to be submerged, the narrow contact area of each tooth and the angle between the bifurcated legs being arranged to create a relatively high compressive force on the surface of the food item so that when the item is immersed in the liquid the compressive forces will be suddenly released due to the softening of the surface to provide a signal to the user that the immersed item has reached the proper consistency and edibility.

19. A holding device for gripping cookies as defined in claim 18 wherein the food contact area formed by the apex of each tooth is a line.

20. A holding device for gripping cookies as defined in claim 18 wherein the device is formed as a one piece integral unit.

* * * * *